US005899790A

United States Patent [19]

Berg

[11] Patent Number: 5,899,790

[45] Date of Patent: May 4, 1999

[54] SCENTED MATERIAL CONTAINER FOR LINGERIE AND THE LIKE

[76] Inventor: Robert Isaac Berg, 7936 Paseo del Ocaso, La Jolla, Calif. 92037

[21] Appl. No.: 09/018,041

[22] Filed: Feb. 3, 1998

Related U.S. Application Data

[63] Continuation-in-part of application No. 29/067,269, Mar. 12, 1997.

[51] Int. Cl.[6] ..... A41B 9/00; A41C 3/00

[52] U.S. Cl. ..... 450/1; 450/57; 2/73; 512/1; 512/4; D23/367

[58] Field of Search ..... 2/1, 83, 46, 48, 2/49.1, 80, 247, 75, 248, 104, 249, 105, 250, 106, 251, 113, 252, 114, 253, 115, 73, 405, 69, 69.5, 400, 401, 402, 403, 404, 406, 407, 408, 409; 450/53, 57, 54, 30, 55, 31, 56, 32, 89; D23/366, 367, 351, 355; 239/36, 152, 153, 653; 512/1, 4

[56] References Cited

U.S. PATENT DOCUMENTS

| | | | |
|---|---|---|---|
| D. 119,897 | 4/1940 | Garry . | |
| D. 119,898 | 4/1940 | Garry . | |
| D. 119,899 | 4/1940 | Garry . | |
| D. 119,900 | 4/1940 | Garry . | |
| D. 121,228 | 6/1940 | Garry . | |
| D. 368,426 | 4/1996 | Kaplan . | |
| D. 387,853 | 12/1997 | Little | D23/367 |
| D. 390,942 | 2/1998 | Mei | D23/367 |
| 924,935 | 6/1909 | Revman et al. . | |
| 1,983,496 | 12/1934 | Ganz . | |
| 2,041,753 | 5/1936 | Ganz . | |
| 2,124,396 | 7/1938 | Frank . | |
| 2,200,840 | 5/1940 | Frank . | |
| 2,256,917 | 9/1941 | Woiwode et al. | 2/243.1 |
| 2,265,789 | 12/1941 | Vivaudou et al. . | |
| 2,320,414 | 6/1943 | Dalloz . | |
| 2,526,087 | 7/1950 | Amyot | 450/1 |
| 2,806,315 | 9/1957 | Kalensky . | |
| 2,886,820 | 5/1959 | Morris | 450/57 |
| 3,185,394 | 5/1965 | Farrell . | |
| 3,733,016 | 5/1973 | Rood . | |
| 4,277,024 | 7/1981 | Spector | 239/36 |
| 4,465,232 | 8/1984 | Field . | |
| 4,744,514 | 5/1988 | Gadoua . | |
| 4,905,898 | 3/1990 | Wade . | |
| 5,056,694 | 10/1991 | Michalik . | |
| 5,197,639 | 3/1993 | Jerman et al. . | |
| 5,416,929 | 5/1995 | Braunstein | 2/406 |
| 5,542,564 | 8/1996 | Wright . | |
| 5,678,251 | 10/1997 | Getz | 2/406 |

*Primary Examiner*—Jeanette Chapman

[57] ABSTRACT

A scented material container with two connected compartments and connected straps. The compartments are preferably made of a fabric material that allows the scented material to emit the scent, preferably having a wide enough stitch pattern to allow the scented material to be viewed therein. Any known scented material can be located within the compartments, however, potpourri is preferred. Most preferably, scented beads or broken-leaf material are used. The scented material container can have a unique lingerie configuration. The container has particular advantages in methods and applications of scenting lingerie because the container readily blends in with the lingerie in the drawer and appears appropriate therein and the scented container enhances one's connotation or image of lingerie products and the beauty therein. The container also has a shape that can easily be manipulated and handled, can easily be hung or mounted, and can easily transmit scent.

11 Claims, 3 Drawing Sheets

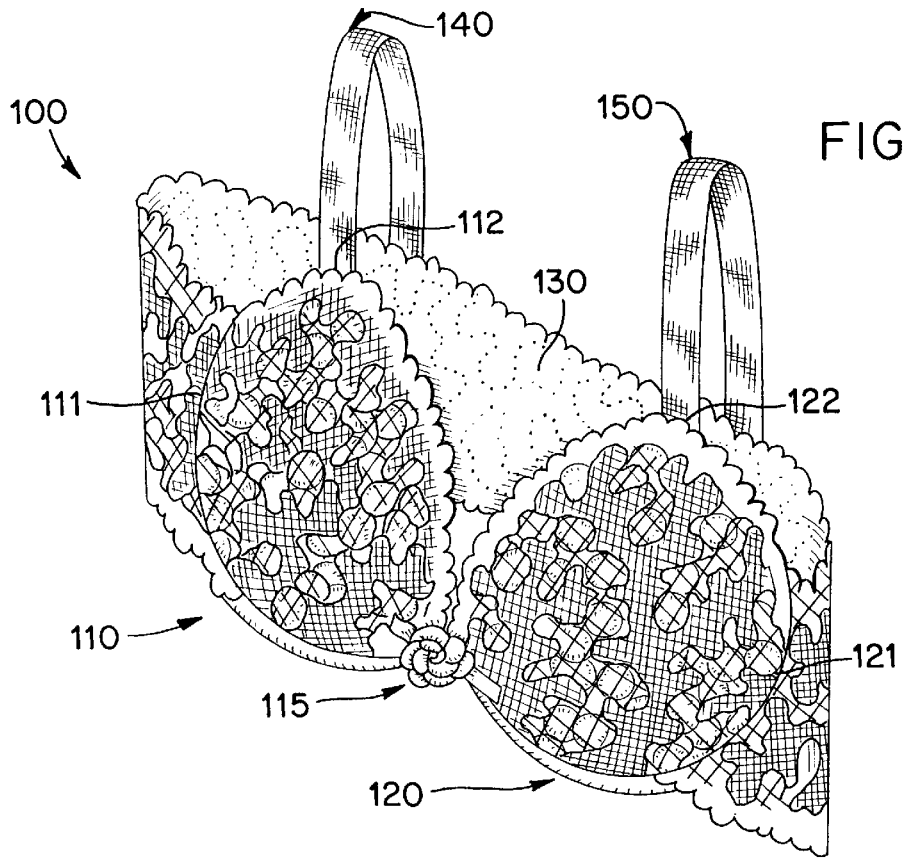
FIG. 1
FIG. 2
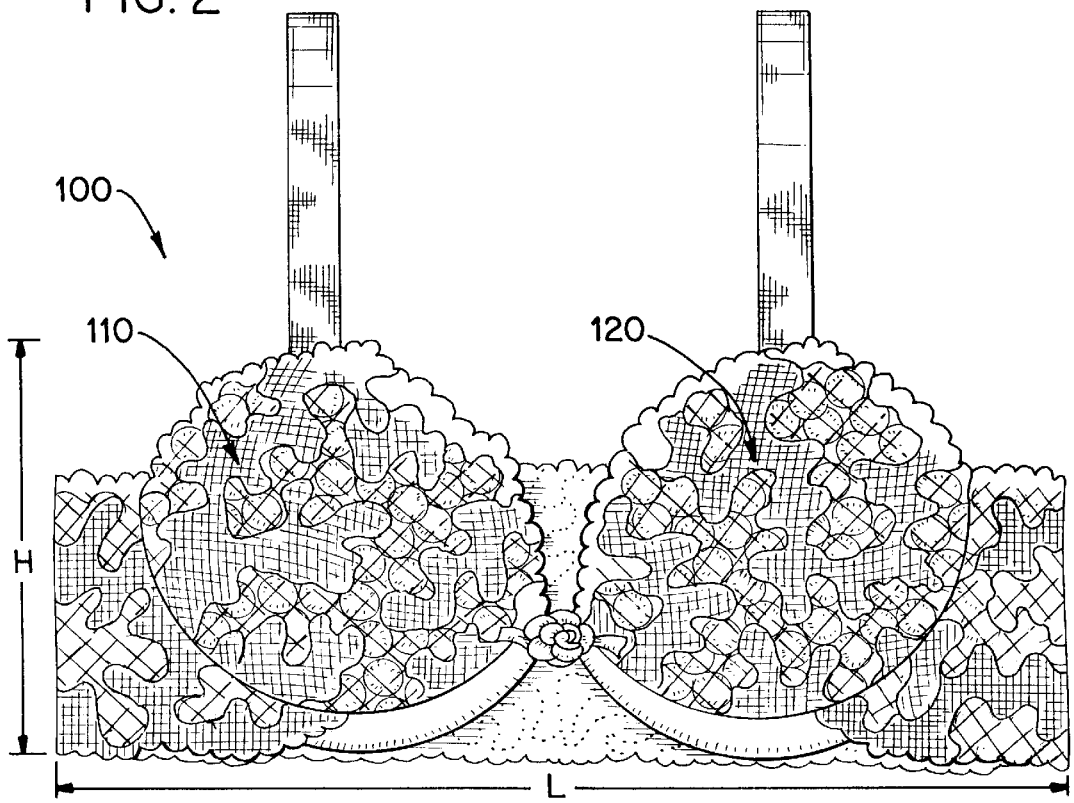

SCENTED MATERIAL CONTAINER FOR LINGERIE AND THE LIKE

BACKGROUND OF THE INVENTION

This application is a continuation-in-part of U.S. Design patent application Ser. No. 29/067,269 filed on Mar. 12, 1997.

1. Field of the Invention

This invention pertains generally to containers for scented materials. More specifically, this invention relates to containers for scented materials, such as sachets, used, as one example, with clothing such as lingerie or the like. This invention also pertains generally to lingerie and means for enhancing the image and positive connotation of lingerie.

The present invention involves a novel container for scented materials having a unique lingerie configuration.

2. Background of the Invention

It is commonly known to provide scented materials for certain items or areas to enhance one's olfactory perception of that item or area. For example, it is common practice to place potpourri in areas that do not typically have an appealing odor, such as inside a vehicle, a bathroom, or the like. It is also common practice for women to place potpourri within a dresser drawer containing lingerie to enhance one's image of the lingerie within the drawer and to possibly enhance the scent of any lingerie contained within the drawer—i.e., the lingerie material "picking up" the scent of the potpourri. As a result, a women's positive feelings towards such lingerie can be enhanced, making the use thereof a more positive experience. The beauty involved in her sexuality—e.g., with her spouse—is enhanced and the misconception that such sexuality is "dirty" or is reduced.

Scented material that is placed within a dresser drawer is typically contained within a single compartment container or sachet. The sachet is typically placed within the dresser drawer along with the woman's lingerie. The use of common scented material containers or sachets within lingerie drawers has a number of drawbacks. First, such containers for the scented material can be highly visible within the drawer. This can make a woman feel self-conscious about her choice to place scented material within the drawer because of its easily noticed presence within the drawer. This reduces one's feeling of the appropriateness of scented material being placed with the lingerie product. Woman may feel self-conscious or may be reluctant to place such scented material within a lingerie drawer.

SUMMARY OF THE INVENTION

The present invention overcomes the above and other problems in the existing devices for containing scented materials and, notably, in containers for scented materials for use in scenting lingerie or the like.

According to a first aspect of the invention, a scented material container is provided comprising: a first breast-shape compartment having a rear fabric wall and a front fabric wall; a second breast-shape compartment having a rear fabric wall and a front fabric wall; a perimeter side of the first compartment being connected to a perimeter side of the second compartment; a strap connected to the first compartment at a side opposite the second compartment and extending around and connected to the second compartment at a side opposite the first compartment; a scented material filled within the first and second compartments; whereby said container is generally configured as a filled brassiere lingerie item.

According to another aspect of the invention, the scented material includes a potpourri material.

According to another aspect of the invention, the potpourri is selected from the group consisting of crushed-leaves and scented beads.

According to another aspect of the invention, the first and second compartments each have a length of less than about three inches.

According to another aspect of the invention, a first over-strap is connected from a top of the first compartment to a rear portion of the strap and a second over-strap connected from a top of the second compartment to a rear portion of the strap.

According to another aspect of the invention, the fabric of at least the front walls of the first and second compartments has a wide stitch pattern with spaces that allow the interior of the compartment to be viewed, such that the scented material therein is visible therethrough.

According to another aspect of the invention, the scented material is compliant to enhance sensuality.

According to another aspect of the invention, a method of using a scented material container to enhance an individual's appreciation of an article of lingerie, involves the steps of: (1) providing a scented material container, having: a first breast-shape compartment having a rear fabric wall and a front fabric wall; a second breast-shape compartment having a rear fabric wall and a front fabric wall; a perimeter side of the first compartment being connected to a perimeter side of the second compartment; a strap connected to the first compartment at a side opposite the second compartment and extending around and connected to the second compartment at a side opposite the first compartment; (2) filling a scented material within the first and second compartments such that said container is generally configured as a filled brassiere lingerie item; and (3) having an individual concurrently view and smell the scented material container to obtain a positive association of the scent with lingerie.

According to another aspect of the invention, the above method further includes the step of placing the scented material container in an enclosed drawer or compartment along with at least one item of lingerie.

The present invention has a number of advantages and uses not available with existing scented material containers and sachets. These advantages and uses are available with certain aspects of the invention as will be appreciated based on the present disclosure.

First, the two compartment—semi-brassiere like—configuration has a number of structural advantages not found in other scented material containers. The use of two compartments helps increase the exposed surface area of the scented material within the container. In addition, the use of a flexible connection between the compartments allows the compartments to be moved relative to one another whereby the structure can be readily adapted to various spaces. Furthermore, the straps 130, 140 and 150 provide versatility in handling and hanging the container—allowing the container to easily be hung on a hanger, a door knob, or a bed post, or on a variety of other structures.

Second, the placement of scented material within a container having such a unique lingerie configuration (a) enhances the positive image of lingerie, (b) facilitates a woman's comfort with and ability to use scented materials with lingerie, and (c) enables a woman or man to appreciate the scent in the context of a lingerie item so as to facilitate selection of an appropriate scent for lingerie. Even further, the unique lingerie configuration enhances the sensuality of the item such that the item can have both (a) visual and (b) olfactory sensuality—in contrast to prior containers. Further, the unique lingerie configuration enhance's the logical connection between (a) the scent and (b) the lingerie. At point of purchase, the desirability of scented lingerie can be readily perceived (e.g., facilitating a spouse or husband's appreciation thereof). In addition, women can feel less self-conscious because the appropriateness of placing a scented container in a lingerie drawer is clarified simply without words or explanations that could otherwise hamper one's mood or state of mind. The present container also is relatively unnoticeable within a lingerie drawer because it blends in with the items therein, reducing potential feelings of awkwardness related thereto. The container can also be used as an item of amusement or humor and can, thus, also be used to reduce tension involved in sexuality.

Third, the container can be relatively inexpensive and easy to fabricate and can be constructed into unique designs having suppleness and sensuality.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which:

FIG. 1 is a perspective view of a scented material container according to a first embodiment of the invention;

FIG. 2 is a front view of another scented material container similar to that shown in FIG. 1;

DETAILED DESCRIPTION OF THE PREFERRED EMBODIMENTS

Figure 3:
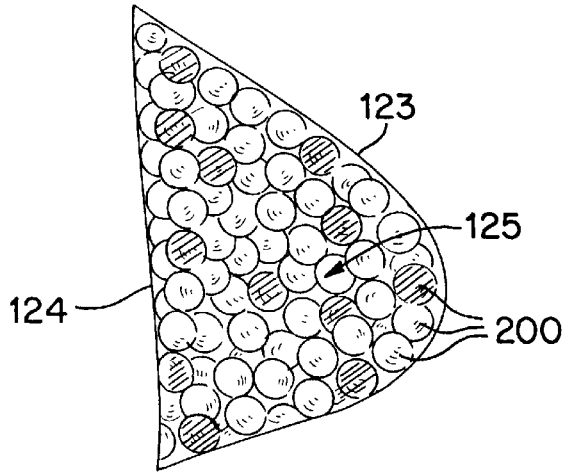
FIG. 3 is cross-sectional view along the arrows 3—3 in FIG. 4.
Figure 4:
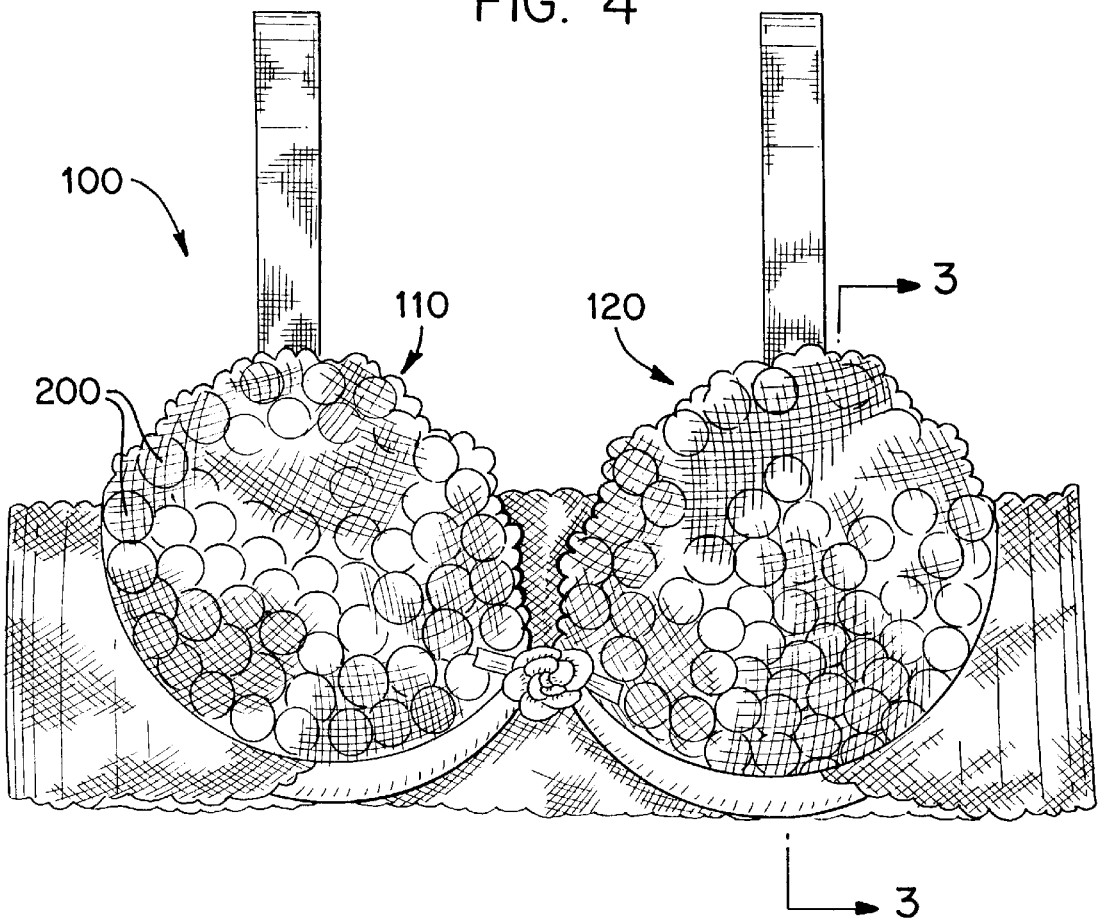
FIG. 4 is a front view of another scented material container similar to that shown in FIG. 1.

FIG. 1 shows one embodiment of the invention, wherein a scented material container 100 has first and second compartments 110 and 120, a central connection 115 between the compartments, and a strap 130 connecting between outer sides 111 and 121 of the compartments 110 and 120, respectively. The strap 130 can be formed as a single strap or as two separate straps extending from respective compartments that are connectable together with hook and loop fasteners (e.g., VELCRO) or with other known brassiere strap-connectors. The container 100 preferably also includes over-straps 140 and 150 connecting the upper regions of the compartments at 112 and 122 to the rear side of the strap 130.

The scented material container has a unique lingerie configuration. Among other things, the unique lingerie configuration is unlike a common lingerie item in the use of "enclosed" filled breast-shaped compartments 110 and 120, rather than "cup-shaped" support structures. As shown in FIG. 3, the compartments preferably have a front wall 123 and a rear wall 124 that form an interior cavity 125 therebetween. The front and rear walls 123 and 124 are connected together—preferably sewn together—around their peripheries to form the enclosed compartments. Preferably, the front and rear walls are connected at or near their outer edges to form large single compartments.

Figure 5:
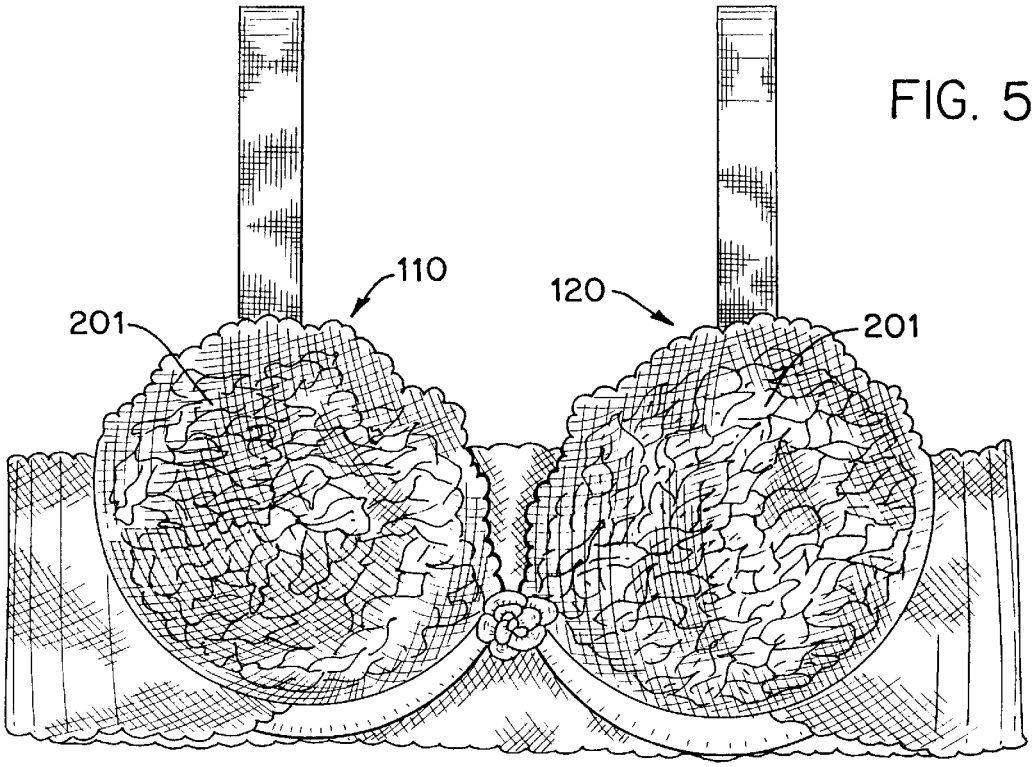
FIG. 5 is a front view of another scented material container similar to that shown in FIG. 1, with leaf-potpourri material therein.

As best shown FIG. 3, the compartment 120 contains a scented material. The scented material preferably fills substantially the entire interior spaces of each of the compartments 110 and 120. The scented material preferably includes a potpourri type scented material. The most preferred potpourri materials are scented beads and crushed-leaf potpourri. Scented beads are known in the art. Exemplary scented beads are "simmering beads" which are known in the art. The scented beads can be made with, for example, a base material (e.g., a polymer, a wax, or other base material) having a scented material therein. The scented beads can also include a coloring agent so that the beads can be colored as desired. Other known scented materials can also be used. In the embodiments shown in FIGS. 1–4, the scented material includes a plurality of scented or potpourri beads 200. In the embodiment illustrated in FIG. 5, the scented material includes a crushed-leaf variety of potpourri 201. Although any known scented material can be included within the compartments 110 and 120, the illustrated potpourri material of the beaded and leaf varieties are most preferred.

Preferably, the scented material allows some compliance and movement to thus have a softness and sensuality. For example, the use of loose potpourri material within the compartments can create a softness to the compartments, enhancing their tactile quality and the sensuality thereof.

The walls 123 and 124 are preferably made of a fabric material. Fabric materials commonly used for making lingerie and other clothing products are preferred. Exemplary preferred fabrics include: synthetic polymers fibers such as polyesters, nylons, acetates, acrylates, rayons, lycra, and, although less preferred, natural fibers such as cotton and silk. The denier number of the fabric can be, for example, in the range of common lingerie fabrics and, more preferably, low enough to provide shear wall surfaces. As one example, a fabric having a denier number of in the range of about or near 15 can be used. Preferably, the material of the walls 123 and 124 is at least partly see-through or semi-transparent. For example, a fabric having spaces between crossing threads (e.g., the warps and wefts) can be used, as is common in portions of lingerie fabric materials. The fabric materials preferably allow the scented material, such as beads 200, to be viewed there-through. This can enhance the visual appearance of the device. In addition, such lingerie fabrics have beneficial qualities in containing scented materials, being relatively strong and porous so as to contain the scented material while allowing the scent to freely permeate therefrom. Although less preferred, other materials can be used either to construct the entire container or portions thereof, including for example, leather (e.g., black leather), plastic, patent leather, other sheet materials having some compliance and known for making articles of clothing, etc. As should be understood, the compartments 110 and 120 should include scent emitting holes when the material used is non-porous.

The scented material container is preferably substantially smaller than a common lingerie item such as a woman's brassiere. In one preferred embodiment, the scented material container has a length L between the outermost ends of the compartments, FIG. 2, of less than about 8 inches. More preferably, the length L is an about 6–6½ inches or less, and a height H, FIG. 2, is about 2½–3 inches or less. FIG. 2 also illustrates exemplary relative proportional sizes according to one possible construction.

The compartments 110 and 120 can be formed in a variety of ways as would be apparent to those in the art.

Figure 6A:
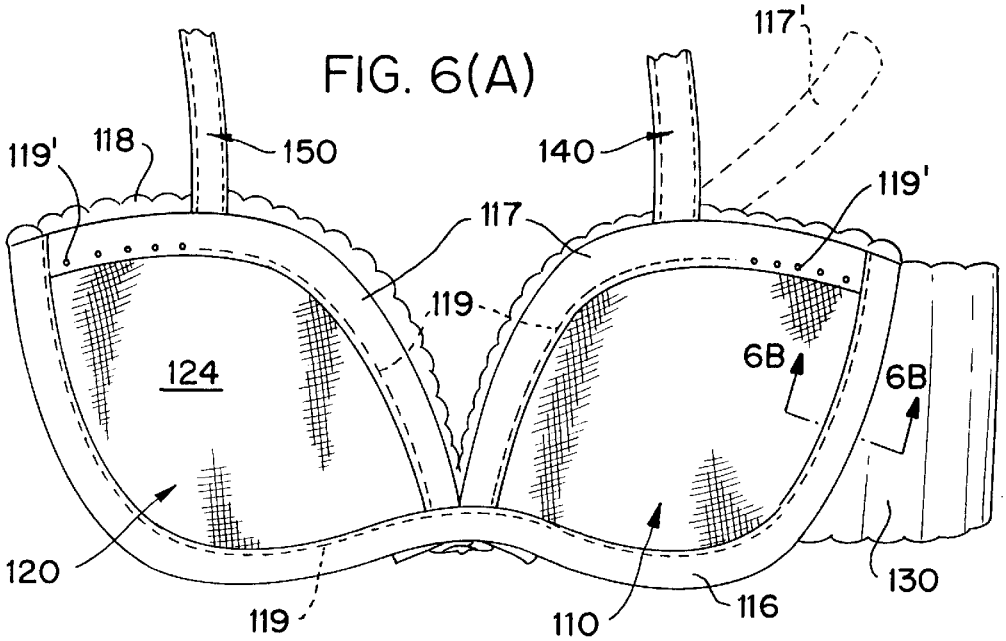
FIG. 6(A) is a rear view of another scented material container according to the invention.
Figure 6B:
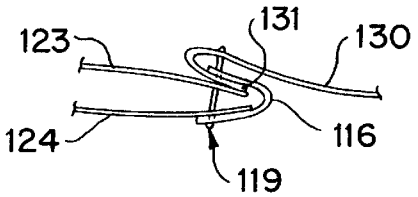
FIG. 6(B) is a cross-sectional view taken along the line 6B—6B shown in FIG. 6(A).

FIGS. 6(A)–6(B) illustrate an embodiment wherein a border is formed around at least a portion of the perimeter of the walls 123 and 124. Such a border is not required in other embodiments. In this particular embodiment, the perimeters of the walls 123 and 124 are connected together at or within the border. FIG. 6(A) shows the rear side of the compartments 110 and 120. The borders 116 and/or 117 preferably wrap around the perimeter edges of the walls 123 and 124 as shown in FIG. 6(B). The borders 116 and/or 117 and the perimeter edges are fixed together, such as with threads 119. A decorative member such as a laced or scalloped strip member 118, FIG. 6(A), can be sewn to the front of each compartment to cover the front side of the borders 117. If desired, the containers can be initially only partly constructed prior to filling. For example, the borders 117 can be sewn only along the dashed-lines 119, but not along the dotted-lines 119'. The partly constructed containers can be stored in an empty state and can be filled with scented material as desired. When filling is desired, the portion 117' can be moved aside to allow access between the walls 123 and 124. The scented material can be placed therein, and then the portion 117' can be threaded to the remainder of the compartment. In another example, when filling scented beads or the like, a small section of the stitching 119, 119' can be left open (e.g., even less than about a ½ inch length) while the remainder of the stitching at 119, 119' is sewn to create a mostly closed compartment. Then, a supply conduit (not shown) having a hollow interior leading to a bead supply (not shown) can be inserted into the opening and beads 200 can be injected from the bead supply through the a discharge end (e.g., a nozzle) of the supply conduit using air pressure from an air pressure source. In this regard, air can be supplied via an air supply tube (not shown) into the supply conduit downstream of the bead supply in a manner to draw beads from the bead supply into and through the supply conduit. The beads can thus be quickly injected into the compartments while air quickly passes through holes, such as in the fabric material, in the walls of the compartments. After filling, the portion of the stitching left open can be sewn closed to finish the product. As shown in FIG. 6(B), the strap 130 can also have its end 131 tucked under the border 116 and sewn therein. In other embodiments without such a border, the perimeter walls 123 and 124 can also—if desired—be initially only partly connected there-around in a similar manner to create a partly constructed container that can be similarly filled with a scented material at an appropriate time.

As noted, the preferred embodiments of the invention have a scented material—preferably scented beads or crushed-leaf potpourri—filling substantially the entire compartments. Some of the scented material can be without scent and/or can be a filler material. For example, portions of potpourri leaves or other materials may have pleasant visual or textural qualities, or may be used to contain the scented material.

As discussed above, the present invention has a number of advantages and uses not available with existing scented material containers and sachets.

First, the two compartment—semi-brassiere like—configuration has a number of structural advantages not found in other scented material containers. The use of two compartments helps increase the exposed surface area of the scented material within the container. In addition, the use of a flexible connection between the compartments allows the compartments to be moved relative to one another whereby the structure can be readily adapted to various spaces. Furthermore, the straps 130, 140 and 150 provide versatility in handling and hanging the container—allowing the container to easily be hung on a hanger, a door knob, or a bed post, or on a variety of other structures.

Second, the placement of scented material within a container having such a unique lingerie configuration (a) enhances the positive image of lingerie, (b) facilitates a woman's comfort with and ability to use scented materials with lingerie, and (c) enables a woman or man to appreciate the scent in the context of a lingerie item so as to facilitate selection of an appropriate scent for lingerie. Even further, the unique lingerie configuration enhances the sensuality of the item such that the item can have both (a) visual and (b) olfactory sensuality—in contrast to prior containers. Further, the unique lingerie configuration enhance's the logical connection between (a) the scent and (b) the lingerie. At point of purchase, the desirability of scented lingerie can be readily perceived (e.g., facilitating a spouse or husband's appreciation thereof). In addition, women can feel less self-conscious because the appropriateness of placing a scented container in a lingerie drawer is clarified simply without words or explanations that could otherwise hamper one's mood or state of mind. The present container also is relatively unnoticeable within a lingerie drawer because it blends in with the items therein, reducing potential feelings of awkwardness related thereto. The container can also be used as an item of amusement or humor and can also be used to reduce tension involved in sexuality.

Third, the container can be relatively inexpensive and easy to fabricate and can be constructed into unique designs having suppleness and sensuality.

While the present invention has been shown and described with reference to preferred embodiments presently contemplated as best modes for carrying out the invention, it is understood that various changes may be made in adapting the invention to different embodiments without departing from the broader inventive concepts disclosed herein and comprehended by the claims which follow.

What is claimed is:

1. A scented material container, comprising:

a first breast-shape compartment having a rear fabric wall and a front fabric wall;

a second breast-shape compartment having a rear fabric wall and a front fabric wall;

a perimeter side of said first compartment being connected to a perimeter side of said second compartment;

a strap connected to said first compartment at a side opposite said second compartment and extending around and connected to said second compartment at a side opposite said first compartment;

a scented material within said first and second compartments;

whereby said container is generally configured as a filled brassiere lingerie item.

2. The scented material container of claim 1, wherein said scented material includes a potpourri material.

3. The scented material container of claim 1, wherein said scented material includes a material selected from the group consisting of crushed-leaves and scented beads.

4. The scented material container of claim 1, wherein said first and second compartments each have a length of less than about three inches.

5. The scented material container of claim 1, further including a first over-strap connected from a top of said first compartment to a rear portion of said strap and a second over-strap connected from a top of said second compartment to a rear portion of said strap.

6. The scented material container of claim 1, wherein said fabric of at least the front walls of said first and second compartments has a wide stitch pattern with spaces that allow the interior of the compartment to be viewed, such that the scented material therein is visible therethrough.

7. The scented material container of claim 1, wherein said scented material is compliant to enhance sensuality.

8. The scented material container of claim 1, wherein said strap includes two strap segments that are connected to respective ones of said compartments and are connectable together to form said strap.

9. A method of using a scented material container to enhance an individual's appreciation of an article of lingerie, comprising the steps of:

providing a scented material container, comprising: a first breast-shape compartment having a rear fabric wall and a front fabric wall; a second breast-shape compartment having a rear fabric wall and a front fabric wall; a perimeter side of said first compartment being connected to a perimeter side of said second compartment; a strap connected to said first compartment at a side opposite said second compartment and extending around and connected to said second compartment at a side opposite said first compartment;

filling a scented material within said first and second compartments such that said container is generally configured as a filled brassiere lingerie item; and placing the breast shaped compartments within an individual's view and smell.

10. The method of claim 9, further comprising the step of placing the scented material container in an enclosed drawer or compartment along with at least one item of lingerie.

11. A scented material container, comprising:

a first breast-shape compartment having a rear wall and a front wall, at least one of said rear and front walls having air permeating openings therethrough;

a second breast-shape compartment having a rear wall and a front wall, at least one of said rear and front walls having air permeating openings therethrough;

a perimeter side of said first compartment being connected to a perimeter side of said second compartment;

a strap connected to said first compartment at a side opposite said second compartment and extending around and connected to said second compartment at a side opposite said first compartment;

a scented material within said first and second compartments;

whereby said container is generally configured as a filled brassiere lingerie item.

* * * * *

UNITED STATES PATENT AND TRADEMARK OFFICE
Certificate

Patent No. 5,899,790 Patented: May 4, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Robert Isaac Berg, La Jolla, CA; and Leland J. Smith. Lawton, OK.

Signed and Sealed this Fifth Day of November 2002.

JOHN J. CALVERT
*Supervisory Patent Examiner*
Art Unit 3765